US006250223B1

(12) United States Patent
Dufour

(10) Patent No.: US 6,250,223 B1
(45) Date of Patent: Jun. 26, 2001

(54) BLANKET TUBE REMOVAL DEVICE

(75) Inventor: Charles Henry Dufour, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/425,328

(22) Filed: Oct. 22, 1999

(51) Int. Cl.[7] ..... B41F 27/00

(52) U.S. Cl. ..... 101/375; 101/217; 101/479; 29/895.23

(58) Field of Search ..... 81/3.43, 64, 65, 81/487; 101/479, 375, 376, 216, 217; 29/895.23, 895.32

(56) References Cited

U.S. PATENT DOCUMENTS

| | | | | |
|---|---|---|---|---|
| 1,329,325 | * | 1/1920 | Mascord | 101/216 |
| 1,355,481 | * | 10/1920 | Lee | 29/895.23 |
| 1,458,140 | * | 6/1923 | Lewis | 81/487 |
| 4,030,415 | * | 6/1977 | Fellows | 101/382.1 |
| 4,119,032 | * | 10/1978 | Hollis | 101/375 |
| 4,461,663 | * | 7/1984 | Tachibana et al. | 101/375 |
| 4,823,693 | * | 4/1989 | Kobler | 101/375 |
| 4,913,048 | | 4/1990 | Tittgemeyer | 101/141 |
| 5,072,504 | * | 12/1991 | Thompson | 29/895.23 |
| 5,289,769 | * | 3/1994 | Lewis | 101/375 |
| 5,309,797 | * | 5/1994 | Nguyen | 81/64 |
| 5,429,048 | | 7/1995 | Gaffney et al. | 101/217 |
| 5,638,754 | * | 6/1997 | Steinmeier et al. | 101/216 |
| 5,745,968 | | 5/1998 | Genest et al. | 29/270 |
| 5,784,961 | * | 7/1998 | Lorig et al. | 101/375 |
| 5,802,975 | * | 9/1998 | Prem et al. | 101/375 |
| 5,816,154 | * | 10/1998 | Stuart | 101/216 |

* cited by examiner

*Primary Examiner*—Stephen R. Funk
(74) *Attorney, Agent, or Firm*—Davidson, Davidson & Kappel, LLC

(57) ABSTRACT

A printing sleeve removal device has at least one band for wrapping around at least part of a printing sleeve and a tightening device connected to the at least one band for tightening the at least one band. Also provided is a method for axially removing a printing sleeve including placing a sleeve removal device over the printing sleeve, tightening the sleeve removal device so as to grasp the sleeve, and axially pulling on the removal device so as to axially remove the printing sleeve.

21 Claims, 6 Drawing Sheets

BLANKET TUBE REMOVAL DEVICE

BACKGROUND OF THE INVENTION

1. Field of the Invention

The present invention relates generally to printing presses and more particularly to a method and device for removing a tubular blanket or tubular plate from a respective printing press cylinder.

2. Background Information

U.S. Pat. No. 5,429,048 to Gaffney et al. discloses an offset lithographic printing press in which a web of material to be printed passes through a series of print units. Each of the print units has a plate cylinder, a blanket cylinder and an impression cylinder, which may be a second blanket cylinder. A flat printing plate containing an image may be fastened to the plate cylinder. A gapless tubular-shaped blanket may be fastened to the blanket cylinder. A frame of the printing unit supports the plate and blanket cylinders. A portion of the frame adjacent one axial end of the blanket cylinder is moveable in order to provide an opening in the frame so as to provide access to one end of the blanket cylinder. The tubular printing blanket, which is replaceable, may be moved axially through the opening in the frame. U.S. Pat. No. 5,429,048 also discloses that the blanket cylinder interior has passages for communicating air to the outer peripheral surface of the blanket cylinder. Air pressure applied to the interior of the blanket cylinder is thus communicated to the interior of the blanket to expand the blanket as the blanket is inserted onto the blanket cylinder. After the blanket is placed over the blanket cylinder, the air pressure may be removed. The blanket then contracts around the blanket cylinder and tightly engages and grips the blanket cylinder. To remove the blanket, air pressure is again applied to enable the blanket to be manually moved off the blanket cylinder.

A problem with the above-mentioned printing press is that the inner surface of the blanket, or the outer surface of the blanket cylinder may become contaminated. For example, sticky substances such as printing inks inadvertently may become attached to the inner surface of the blanket. When an operator attempts to remove the blanket from the blanket cylinder by providing air pressure to the inner surface of the blanket and sliding the blanket off axially, the sticky substances may prevent easy removal. Likewise, manufacturing imperfections or environmental conditions such as humidity and temperature can cause the blanket to be difficult to remove.

Moreover, the operator must reach inside the print unit to remove the blanket, which if the printing press malfunctions, can cause operator injury.

U.S. Pat. No. 4,913,048 to Tittgemeyer discloses a printing press with a sleeve-shaped gapless printing form or plate which may contain an image. This sleeve-shaped printing plate is axially removable over the plate cylinder. The sleeve-shaped printing plate may be fastened to the plate cylinder by expanding the plate with pressure from a pressure medium. The sleeve-shaped printing plate is then moved manually over the plate cylinder and allowed to relax.

This type of printing press with axially removable printing forms may suffer from the same problems as that disclosed in U.S. Pat. No. 5,429,048.

BRIEF SUMMARY OF THE INVENTION

An object of the present invention is to provide a device to aid in the axial removal of blankets or other types of printing sleeves. An additional or alternative object is to provide a method for axially removing blankets or other types of printing sleeves.

The present invention provides a printing sleeve removal device comprising at least one band for wrapping around at least part of a printing sleeve and a tightening device connected to at least one band for tightening at least one band.

Advantageously, at least one band of the printing sleeve removal device includes a first semicircular band and a second semicircular band. More than one band and/or tightening device can be included to provide balanced pulling force on the printing sleeve. This would in turn minimize any tendency to bind as the printing sleeve is removed. These bands may be connected at one end by the tightening device and at their other ends by a second tightening device, so that the removal device is in a circular shape which can be placed axially over the printing sleeve. This form aids in quick and simple application of the device and permits an operator to remove a blanket or other type of printing sleeve without placing bodily parts within the print unit.

Each tightening device may comprise a first side plate and a second side plate, the two side plates supporting a first pin and a second pin. The pins preferably are non-rotatably fixed to the side plates, and one of the first pin and the second pin is attached to an actuating rod. One end of the first band is attached rotatably to the first pin and an end of the second band is attached rotatably to the second pin.

By twisting a handle on the actuating rod of at least one of the tightening devices, the tightening device twists so the effective diameter of the circle formed by the first and second semicircular bands is reduced. Preferably two tightening devices are actuated to reduce the effective diameter. As a result, when the removal device is placed over a printing sleeve and the tightening devices are actuated, the sleeve may be firmly grasped and axially removed.

The present device forms an effective and safe way for removing printing sleeves. The sleeve may be grasped more firmly than by hand, and the operator need not place bodily parts within the print unit.

The present device is particularly applicable to axially removable blankets of the type described in U.S. Pat. No. 5,429,048, which is hereby incorporated by reference herein. The compressibility of the outer layer of the blanket provides a firm grip on the blanket for the device, without necessarily squeezing the innermost tube of the blanket, which could create disadvantageous friction between the innermost tube and the blanket cylinder. This friction could make removal of the blanket more difficult. It may be desirable to have the printing sleeve removal device clamp and pull on the sleeve as opposed to the rubber blanket on the sleeve in order to not damage the blanket surface or to get at a slightly smaller diameter.

An alternative is to have the printing sleeve tube extend past the cylinder body end and expand the removal device inside the tube to create the frictional force on the inside of the tube and then remove accordingly.

Although not as effective as for use with blankets, the present device also may be used with other types printing sleeves, such as the tubular printing sleeves described in U.S. Pat. No. 4,913,048, which is also hereby incorporated by reference herein.

Another alternative is to have a lip or slightly larger diameter on the end of the printing sleeve. That allows the sleeve removal device to reduce diameter and pull directly on the lip as opposed to relying on frictional clamping force.

The present invention also provides a method for axially removing a printing sleeve comprising placing a sleeve removal device over the printing sleeve, tightening the sleeve removal device so as to grasp the sleeve, and axially pulling on the removal device so as to axially remove the printing sleeve. This method provides a safe and effective way to remove printing sleeves.

Advantageously, the above method further includes providing air pressure to an inner surface of the printing sleeve. Moreover, the above method preferably is used with a sleeve which is a blanket in an offset printing unit. The tightening step then may include tightening the sleeve removal device so as to compress a compressible layer of the blanket. An inner tube of the sleeve thus advantageously may remain unaffected by the removal device.

The present device need not be used for every blanket removal. A press operator may first attempt to remove a blanket manually, and determine if the blanket sticks. If so, the operator utilizes the removal device. The present invention therefore also advantageously includes a method of axial removal of a printing sleeve comprising attempting to manually remove a printing sleeve axially, determining that the sleeve cannot be manually removed, placing a sleeve removal device over the printing sleeve, tightening the sleeve removal device so as to grasp the sleeve, and axially pulling on the removal device so as to axially remove the printing sleeve

BRIEF DESCRIPTION OF THE DRAWINGS

The present invention is described below by reference to the following drawings, in which.

DETAILED DESCRIPTION

Figure 1:
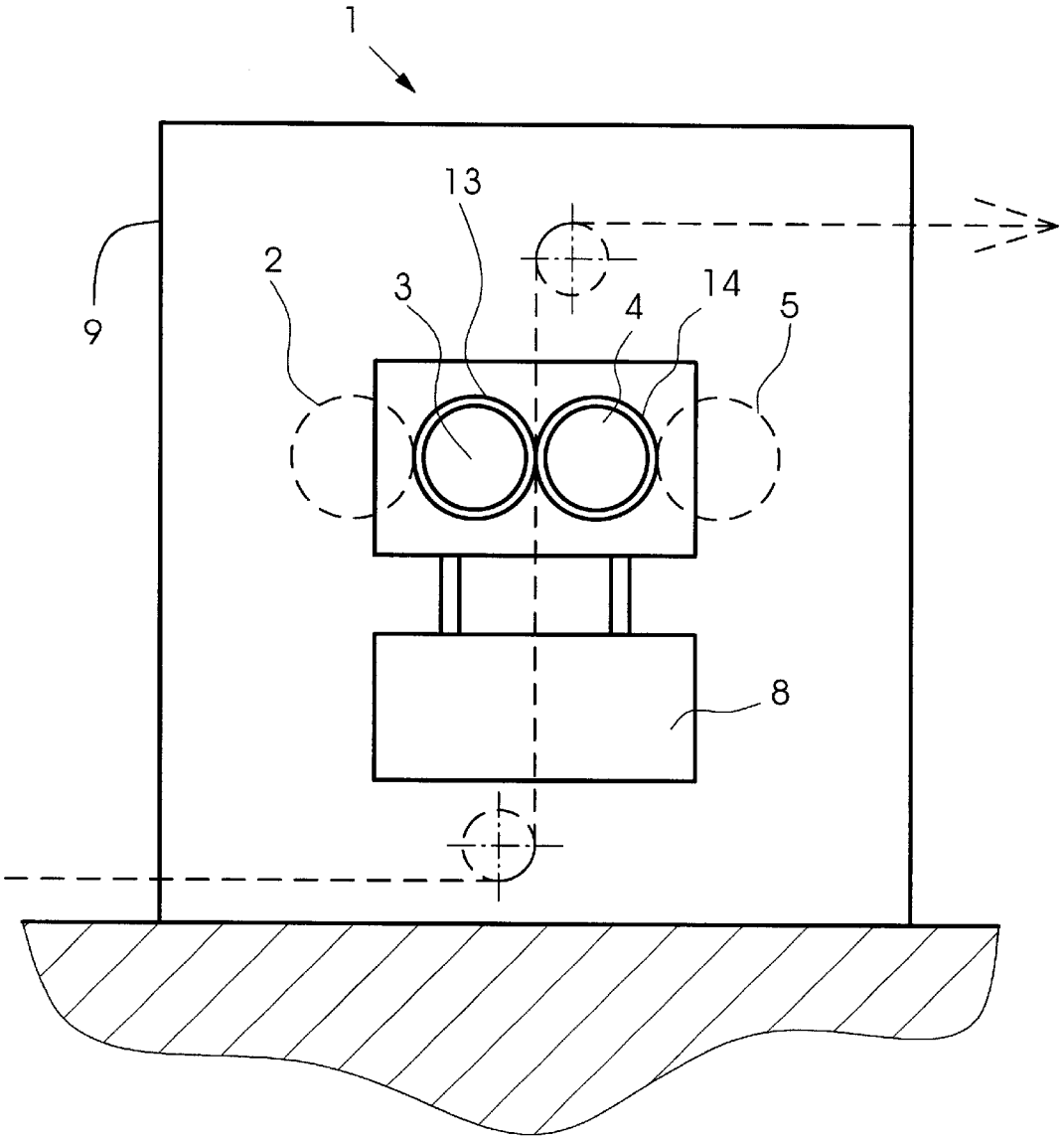
FIG. 1 shows a side view of a print unit of a vertical offset web printing press.

FIG. 1 shows in side view a print unit 1 of a vertical lithographic offset web printing press. Schematically depicted is a left plate cylinder 2, a left blanket cylinder 3, a right blanket cylinder 4 and a right plate cylinder 5. On the left blanket cylinder 3 is an axially removable blanket 13, which can placed on blanket cylinder 3 in the manner described in U.S. Pat. No. 5,429,048. Right blanket cylinder 4 likewise has an other axially removable blanket 14. During a print operation of print unit 1, a web of material, such as paper, passes through a nip formed between blanket 13 and right blanket 14. A door 8 or two doors, shown schematically, can open in the side of a frame 9, so as to form an opening to permit the axial removal of blankets 13 and 14. Blankets 13 and 14 however may become sticky or difficult to remove, from imperfections in manufacture, from contamination or even from environmental conditions such as humidity or temperature. It is noted that the blanket cylinders 3 and 4 can be moved so that each is free from contact with any other cylinders.

Figure 2:
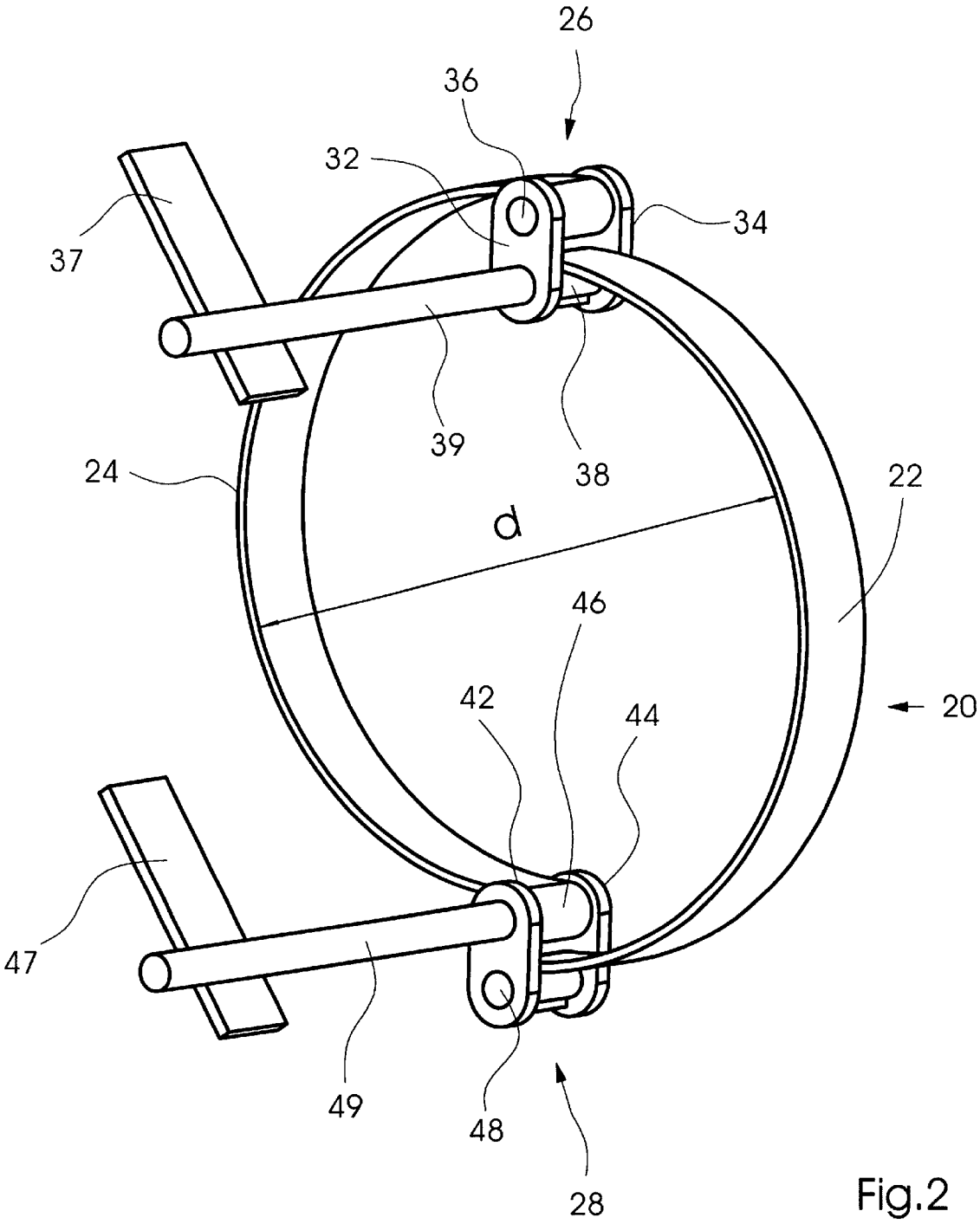
FIG. 2 shows a perspective view of an embodiment of the removal device of the present invention.

FIG. 2 shows a printing sleeve removal device 20 of the present invention to aid in removing printing sleeves such as blankets 13 and 14 when stuck. The embodiment of FIG. 2 includes a first band 22 and a second band 24. The bands preferably are one inch wide and made of 16 gauge steel or other metal. The bands are connected at a first end by a first tightening device 26 and at their other ends by a second tightening device 28.

First tightening device 26 includes a first side plate 32 and a second side plate 34. A first pin 36 and a second pin 38 are non-rotatably fixed between side plate 32 and side plate 34. An actuating rod 39 is connected to or an integral extension of second pin 38. The pins preferably are 0.188 inch in diameter, and the rod has a 0.313 diameter, and may be made of a metal such as steel. The side plates also preferably are made of metal such as steel. The rod is preferably about 15 inches in length. Attached fixedly at another end of the rod 39 is a handle 37.

Similar to tightening device 26, tightening device 28 has a first side plate 42 and a second side plate 44, a first fixed pin 46 and a second fixed pin 48. An actuating rod 49 is attached or integral with first fixed pin 46 and has a handle 47 at the other end.

The removal device 20 forms an effective diameter d when tightening devices 26 and 28 are tightened which matches or is slightly smaller than the outer diameter of the sleeve to be removed. For example the effective diameter may be 7.02 inches to remove a compressible blanket, which has an outer diameter slightly larger than 7.02 inches.

Figure 3:
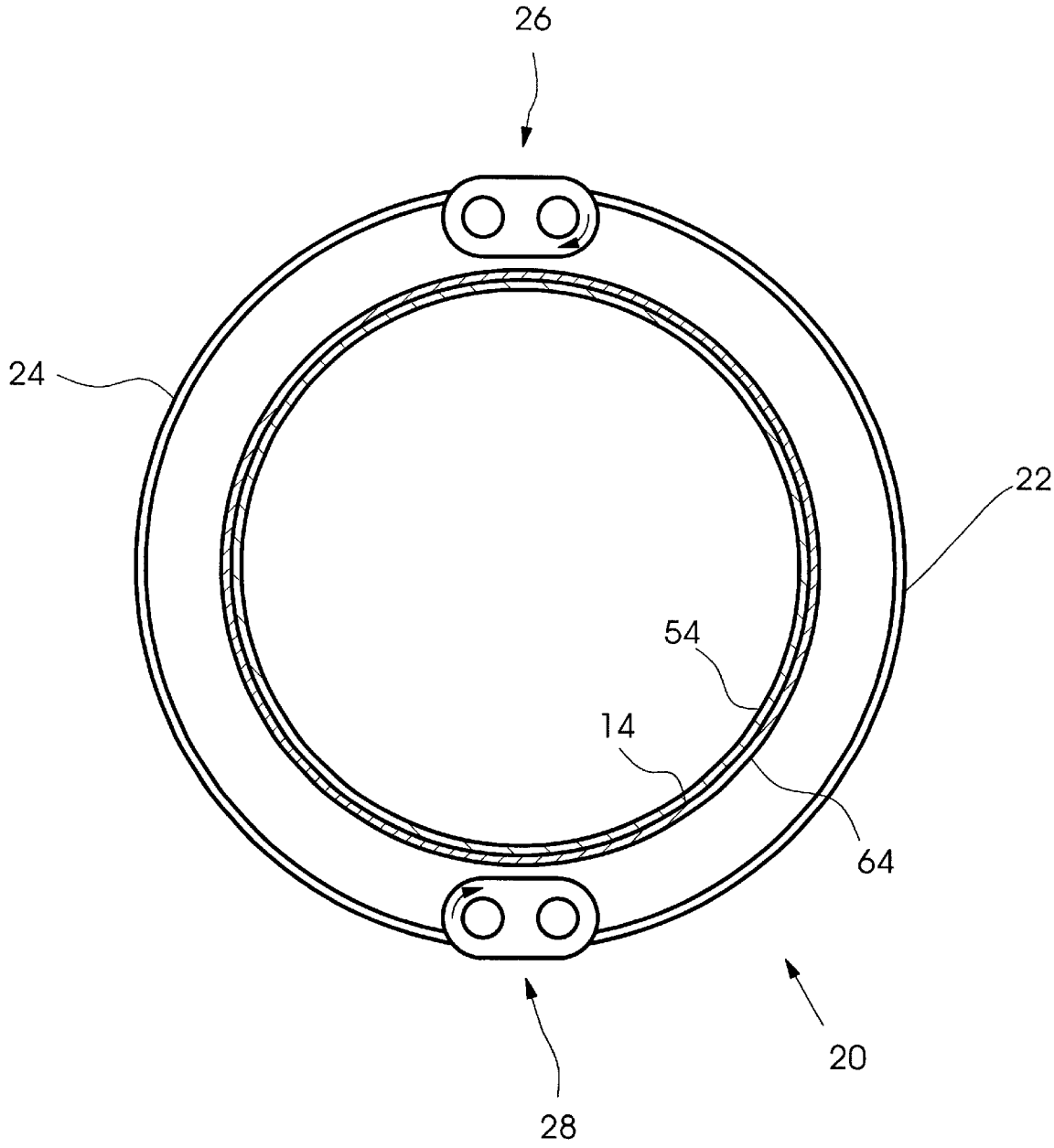
FIG. 3 shows a schematic side view of the placing of the removal device over a printing sleeve before tightening.

FIG. 3 shows a schematic side view of the removal device 20 of FIG. 2 in a non-tightened position being placed axially over the blanket 14 of FIG. 1. The blanket may have a compressible layer 64 and an inner tube 54. Compressible layer may be a composite of incompressible material such as rubber without significant voids, and a compressible material such as rubber with voids. The device 20 is placed over blanket 14 by an operator.

Figure 4:
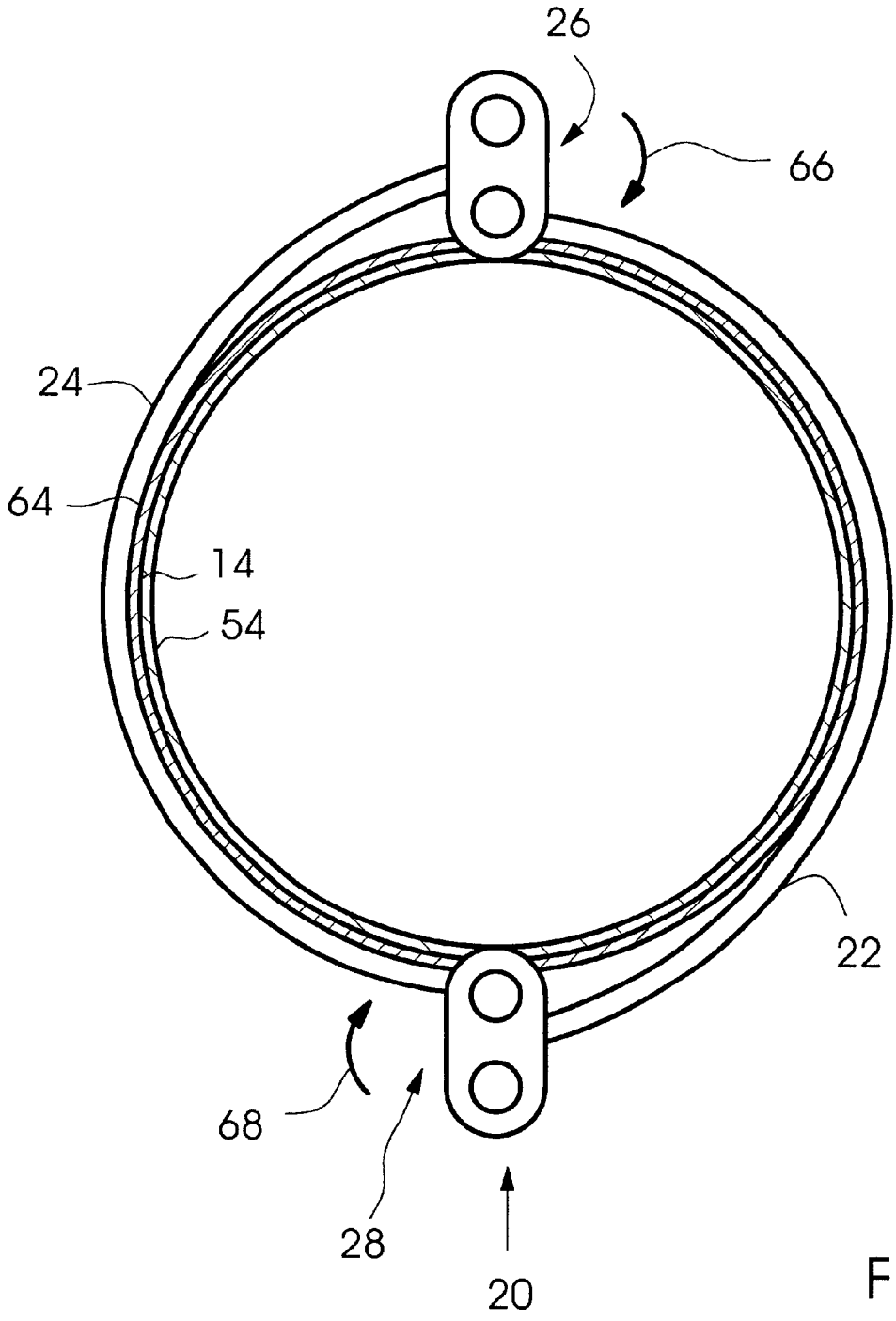
FIG. 4 shows a schematic side view of the tightened state of the removal device over the printing sleeve.
Figure 5:
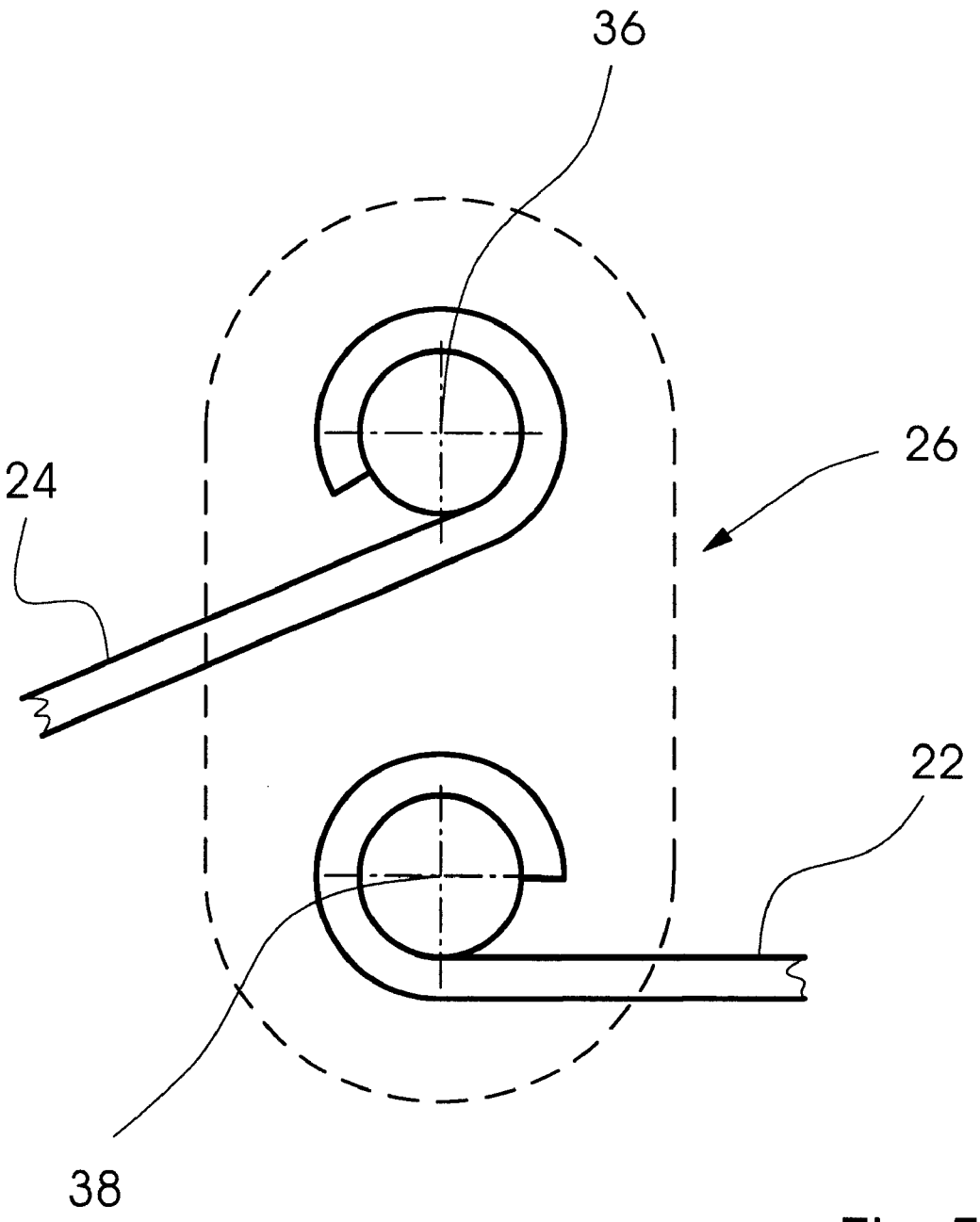
FIG. 5 shows a schematic side view of tightening device of the removal device.

FIG. 4 shows a schematic side view of the removal device 20 tightened about blanket 14. The first and second tightening devices 26 and 28 are actuated by an operator twisting the handles 37 and 47 of FIG. 2 in the direction of arrows 66 and 68, i.e. clockwise. As shown in FIG. 5, the first band 22 is wrapped around the second pin 38 and is rotatably movable about the pin 38. The second band 24 is also rotatably moveable about second pin 36. Thus the twisting in the clockwise direction of the handle 37 (FIG. 2), which is fixed in relation to the pins and the side plates, causes the tightening device 26 to move from the position shown in FIG. 3 to the position shown in FIG. 4. The effective diameter of the removal device 20 thus is reduced and bands 22 and 24 tighten about the blanket 14. The compressible layer 64 is squeezed, and thus the blanket may be pulled out axially by the operator through the opening 10 shown in FIG. 1. It is noted that the tightening devices 26, 28 could rotate even further in the clockwise direction as desired by the operator to provide an even tighter squeeze by the removal device 20.

Figure 6:
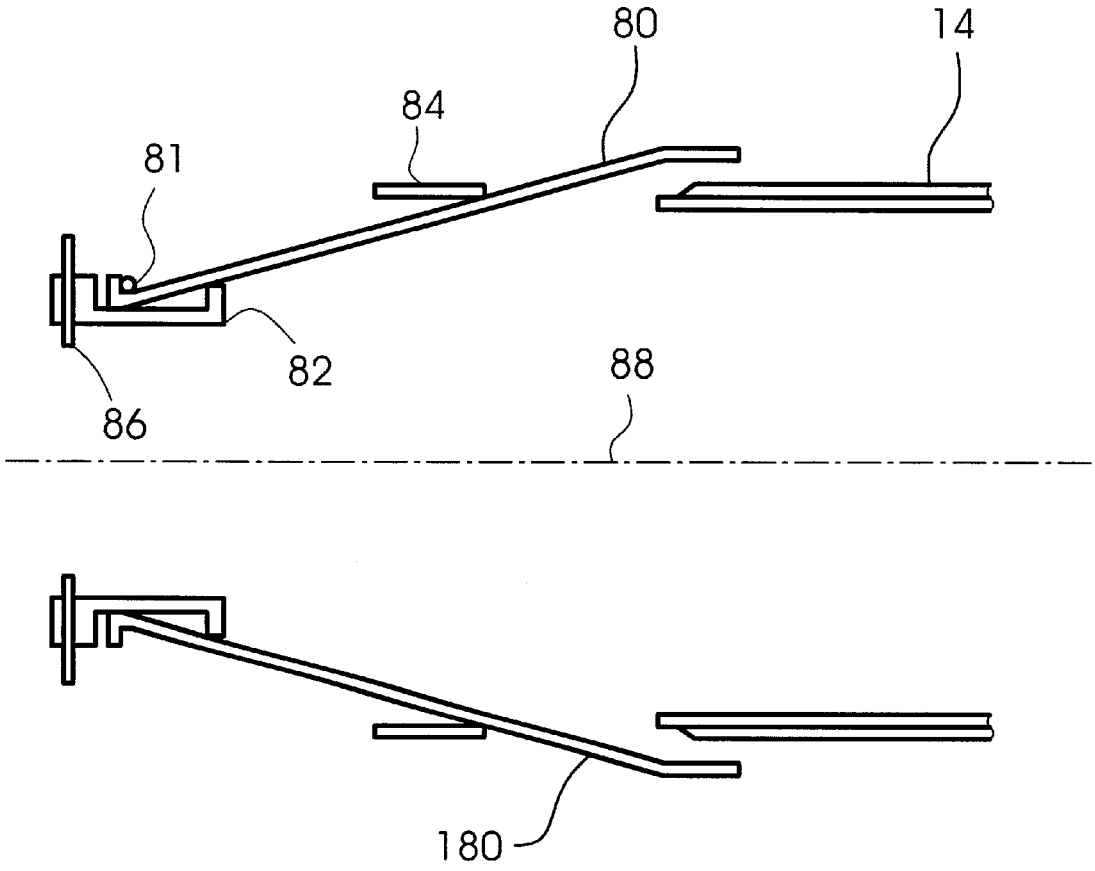
FIG. 6 shows a cross-sectional view of an alternate embodiment of the present invention.

FIG. 6 shows an alternate embodiment of the present invention. A plurality of bands 80, 180 are spaced apart circumferentially about a base ring 82. Each band 80, 180 has an associated spring 81, which forces bands 80, 180 against a slide ring 84. The base ring has pulling rings 86 to pull the base ring toward a press operator. The alternate embodiment functions so that an operator places the bands over the sleeve 14 or blanket and then moves the slide ring 84 or tightening device toward sleeve 14, which has a centerline 88. The bands 80, 180 are thus forced against sleeve 14 and grip sleeve 14. Sleeve 14 may then be removed by the operator by pulling with at least one hand at a pulling ring 86.

While the first embodiment has been described with reference to a two band structure, it is also possible that a single band be used. A printing or print sleeve as used herein may be any type of tube used in a printing press, such as a gapless printing plate or form, or a printing blanket. Moreover, "band" as defined herein can include any elongated structure with any type of cross-sectioned shape, including a rectangular cross-section as described above or a circular cross-section, i.e. cable-like.

What is claimed is:

1. A printing sleeve removal device and printing press combination comprising:

at least one printing unit having a printing sleeve on a printing cylinder and a frame; and a sleeve removal device unattached and moveable with respect to the at least one printing unit, the sleeve removal device having at least one band selectively contacting at least part of the printing sleeve through an opening in the frame; and a tightening device connected to the at least one band permitting tightening of the at least one band so as to grasp an outer surface of the printing sleeve.

2. The removal device as recited in claim 1 wherein the at least one band of the printing sleeve removal device includes a first semicircular band and a second semicircular band.

3. The removal device as recited in claim 2 further comprising a second tightening device connecting the first band to the second band, the tightening device also connecting the first band to the second band.

4. The removal device as recited in claim 1 wherein the at least one band forms a partially circular shape.

5. The removal device as recited in claim 1 wherein the tightening device includes a first side plate and a second side plate, and a first pin and a second pin connecting the first side plate and the second side plate.

6. The printing sleeve removal device as recited in claim 1 wherein the at least one band defines a plane, the tightening device including at least one rod fixed perpendicularly with respect to the plane.

7. The printing sleeve as recited in claim 1 wherein the tightening device includes at least one pin and a handle, the at least one pin and the handle having parallel axes.

8. A printing sleeve removal device comprising:

at least one band for contacting at least part of a printing sleeve; and a tightening device connected to the at least one band, the tightening device including a first side plate and a second side plate, and a first pin and second pin connecting the first side plate and the second side plate, wherein the first and second pins are non-rotatably fixed to the first and second side plates.

9. The removal device as recited in claim 8 wherein the tightening device includes an actuating rod.

10. The removal device as recited in claim 8 wherein the at least one band includes a first band and a second band, a first end of the first band being attached rotatably to the first pin and a second end of the second band being attached rotatably to the second pin.

11. A printing sleeve removal device comprising:

at least one band for contacting at least part of a printing sleeve; and a tightening device connected to the at least one band, and a base ring, the at least one band including at least two bands supported circumferentially about the base ring, and wherein the tightening device is a slide ring disposed over the at least two bands.

12. A method for axially removing a printing sleeve comprising the steps of:

placing a sleeve removal device over the printing sleeve while the printing sleeve is located on a printing cylinder in a printing press;

tightening the device so as to grasp the sleeve; and axially pulling on the removal device so as to axially remove the printing sleeve, the removal device as a result being unattached and independently movable with respect to the printing press.

13. The method as recited in claim 12 further comprising the step of providing air pressure to an inner surface of the printing sleeve.

14. The method as recited in claim 12 wherein the printing sleeve is a blanket.

15. The method as recited in claim 14 wherein the tightening step includes compressing a compressible layer of the blanket.

16. A method for axially removing a printing sleeve comprising the steps of:

attempting to manually remove a printing sleeve axially while the printing sleeve is located on a printing cylinder in a printing press;

determining that the sleeve cannot be manually removed;

placing a sleeve removal device over the printing sleeve while the printing sleeve is located on the printing cylinder in the printing press;

tightening the device so as to grasp the sleeve; and axially pulling on the removal device so as to axially remove the printing sleeve, the removal device as a result being unattached and independently movable with respect to the printing press.

17. The method as recited in claim 16 further comprising the step of providing air pressure to an inner surface of the printing sleeve.

18. The method as recited in claim 16 wherein the printing sleeve is a blanket.

19. The method as recited in claim 18 wherein the tightening step includes compressing a compressible layer of the blanket.

20. A method for axially removing a printing sleeve comprising the steps of:

placing a sleeve removal device over the printing sleeve;

tightening the device so as to grasp the sleeve; and axially pulling on the removal device so as to axially remove the printing sleeve, wherein the tightening device is actuated by twisting an actuating rod.

21. A method for axially removing a printing sleeve comprising the steps of:

attempting to manually remove a printing sleeve axially;

determining that the sleeve cannot be manually removed;

placing a sleeve removal device over the printing sleeve;

tightening the sleeve device so as to grasp the sleeve; and axially pulling on the removal device so as to axially remove the printing sleeve;

wherein the tightening device is actuated by twisting an actuating rod.

* * * * *